United States Patent [19]

O'Banion et al.

[11] Patent Number: 4,947,908

[45] Date of Patent: Aug. 14, 1990

[54] METHOD AND TOOL FOR FORMING BISCUIT JOINTS

[75] Inventors: Michael L. O'Banion, Westminster; Scott D. Price, Pylesville, both of Md.

[73] Assignee: Black & Decker, Inc., Newark, Del.

[21] Appl. No.: 473,248

[22] Filed: Jan. 31, 1990

[51] Int. Cl.[5] ..... B27F 7/00; B27C 5/02

[52] U.S. Cl. ..... 144/353; 144/70; 144/83; 144/134 D; 144/136 C; 144/345; 144/355; 409/175; 409/182; 409/190

[58] Field of Search ..... 409/175, 17.8, 179, 409/182, 190; 144/70, 80, 81, 82, 83, 84, 134 R, 134 D, 136 R, 136 C, 137, 345, 346, 353, 355

[56] References Cited

U.S. PATENT DOCUMENTS

| | | | |
|---|---|---|---|
| 1,469,170 | 9/1923 | Norris | 409/190 |
| 1,642,723 | 9/1927 | Wallace | 409/190 |
| 1,698,068 | 1/1929 | Ranney . | |
| 2,702,569 | 2/1955 | Yelle . | |
| 2,823,591 | 2/1958 | Craddock et al. | 409/190 |
| 3,212,541 | 10/1965 | Burrows et al. . | |
| 3,288,183 | 11/1966 | Eisbrenner . | |
| 4,056,136 | 11/1977 | Miller . | |
| 4,572,715 | 1/1986 | Wolff . | |
| 4,655,653 | 4/1987 | Hall et al. | 409/182 |
| 4,674,548 | 6/1987 | Mills et al. | 409/182 |
| 4,742,856 | 5/1988 | Hehr et al. . | |
| 4,792,248 | 12/1988 | Mercurio | 409/178 |
| 4,858,662 | 8/1989 | Bosten et al. | 144/136 C |
| 4,920,464 | 9/1981 | Mansan | 144/136 C |

FOREIGN PATENT DOCUMENTS

| | | |
|---|---|---|
| 0024251 | 7/1980 | European Pat. Off. . |
| 3347914 | 1/1981 | Fed. Rep. of Germany . |
| 3040651 | 9/1983 | Fed. Rep. of Germany . |
| 8101930 | 10/1985 | Fed. Rep. of Germany . |
| 2953847 | 3/1987 | Fed. Rep. of Germany . |
| 15439 | of 1912 | United Kingdom . |
| 725025 | 3/1955 | United Kingdom . |

OTHER PUBLICATIONS

"How to Use the Freud Joiner Machine", Edward A. Baldwin, *Workbench Magazine*, Apr. 1988, pp. 19–28.

*Primary Examiner*—W. Donald Bray

*Attorney, Agent, or Firm*—Dennis A. Dearing; Charles E. Yocum; John D. Del Ponti

[57] ABSTRACT

A simple, low cost, light weight biscuit jointer (21) comprises an elongated motor housing (23), a motor end cap assembly (25) fixed to one end of housing (23) and a base assembly (27) for engagement with a workpiece. To form a biscuit receiving slot in a workpiece, the motor housing (23) and end cap assembly (25) are pivoted relative to base assembly (27) for sweeping a an elongated, generally cylindrical bit (29) through an opening (31) in a base plate (33). The sweeping action is effected by an operator rotating a handle (35) fixed to end cap assembly (25) counterclockwise (FIG. 2) relative to base assembly (27). A handle (37) is used to stabilize base assembly (27) as house assembly (23) is pivoted to form the slot.

22 Claims, 9 Drawing Sheets

METHOD AND TOOL FOR FORMING BISCUIT JOINTS

FIELD OF THE INVENTION

This invention relates to power biscuit jointers for cutting slots in workpieces for forming biscuit joints and a method for using a power jointer for forming such joints.

BACKGROUND OF THE INVENTION

As depicted in FIGS. 11A, 11B, joints between two workpieces, e.g. two pieces 211, 213 of wood when making furniture, can be made by gluing a thin, egg shaped wooden wafer 215 ("biscuit" or "spline") in the two workpieces 211, 213. To do this, a similar size slot 217, 219 is made in each workpiece 211, 213 and glue is applied in the slots 217, 219 and/or on wafer 215. The wafer 215 is inserted in one slot to approximately one-half the width of the wafer. Then the two workpieces 211, 213 are abutted so that the projecting half of the wafer is inserted into the other slot. The two workpieces 211, 213 are then clamped together until the glue sets. If desirable, several such wafers 215 can be inserted into a mating slot 217, 219 in each workpiece 211, 213 at spaced locations throughout the joint. All such wafers are partly assembled before the two workpieces 211, 213 are clamped together.

A function of the wafers is to locate the two workpieces more accurately in the joint. The strength of the biscuit joint is increased due to the added glue area and the strength of the wafer compared to a standard glued joint.

Portable power tools have been developed from making the wafer receiving slots by plunge cutting. Such tools may be referred to as biscuit jointers, power biscuit jointer cutters or plate jointers.

Commercially available biscuit jointers generally comprise a circular saw blade, preferably carbide tipped and 4 inch (10 cm) in diameter, and a universal motor for driving the blade through an intermediate right angle gear train and drive shaft. (The axis of rotation of the blade and drive shaft is perpendicular to the armature shaft of the motor.) Such jointers function well, however, their complexity and resultant cost limit their marketability. An example of a jointer of this type is disclosed in U.S. patent application Ser. No. 7-413,939, filed Sep. 28, 1989 and assigned to the assignee of the invention herein.

SUMMARY OF THE INVENTION

A primary object of the present invention is to provide a simplified, low cost, maneuverable biscuit jointer and method for using such a jointer for forming biscuit joints.

The present invention is particularly concerned with utilization of a jointer with an elongated, generally cylindrical bit for forming the wafer receiving slots and the method for using the jointer to form such slots.

In accordance with one aspect of the invention, as embodied and described herein, a biscuit jointer comprises a motor for driving an elongated bit; a housing for the motor; and a base assembly having a back face, a planar front face for engagement with a workpiece, and an opening with opposed end walls. The motor housing is pivotally mounted on the back face of the base assembly for rotation about an axis and for sweeping the bit through the base opening and the distal bit tip through an arc. The arc is defined by a fixed radius, intersects with two spaced points in the plane of the front face and extends outwardly from the front face between the two points.

To cut slots of different sizes to accommodate wafers of different sizes, the fixed radius cf the distal bit tip may be adjusted either by adjusting the extension of the bit from a chuck cavity or by adjusting the rotational axis toward and away from the front face of the base assembly.

For laterally aligning the bit, the base assembly may further comprise a pair of spaced, parallel, alignment walls on the back face. For longitudinal alignment of the bit relative to the site where the maximum depth of cut into the workpiece will be made, each wall may comprise an index.

The pivotal mounting may comprise a pair of spaced stanchions extending from the back face of the base assembly and a pair of trunnions extending from opposite sides of the housing. Each trunnion is supported in a respective one of the stanchions.

The cutter tip is preferably biased by a bias means, preferably a torsion spring, to locate the bit tip in a rest position adjacent to one of the end walls of the base opening.

For ease of operation and maneuverability, the jointer preferably further comprises a first handle attached to the back face of the base assembly and a second handle fixed to the pivot for the motor housing for pivoting the motor housing relative to the base. The first handle is preferably fixed to the back face adjacent to one of the trunnions and the second handle is fixed to the other trunnion.

To increase the stability of the base assembly on a workpiece, an abrasive material (preferably sandpaper) may be applied to the front face of the base assembly.

To aid in locating the jointer relative to a workpiece, the base assembly may further comprise a fence movably mounted on the front face of the base toward and away from the bit in a direction parallel to the rotational axis of the bit. The fence is preferably reversably and releasably fixed to the base by a clamp. A tongue and groove connection between the fence and front face of the base assembly may be provided to guide movement of the fence.

In accordance with another aspect of the invention, the method for using the jointer described above comprises steps of (1) locating the base assembly on a first workpiece and (2) pivoting the housing relative to the base assembly about the rotational axis for sweeping the bit through the base opening and the distal bit tip through an arc to form a first slot in the first workpiece. The slot has a width equal to the diameter of the bit and a radiused bottom defined by the radius between the rotational axis and the distal bit tip. The base assembly is then located on a second workpiece and a second slot is formed in the second workpiece in a identical matter to the formation of the first slot in the first workpiece. The formation of the joint is then completed in a conventional manner by applying glue in the slots, partially inserting a wafer in the first slot and inserting a portion of the wafer protruding from the first slot into the second slot to form a joint between the two workpieces.

To aid in locating the jointer for cutting a mating slot in each workpiece, the alignment wall may be aligned with a lateral demarkation on the first workpiece and an index on the alignment wall may be aligned with a longitudinal demarkation on the workpiece.

Prior to the formation of the first and second slots, the distance between the bit rotational axis and the distal bit tip may be adjusted to vary the size of the slots to be formed to accommodate the size of the wafer chosen for use.

Lastly, to form each slot, (1) the first handle may be gripped in one hand, (2) the second handle may be gripped in the other hand and (3) the housing may be pivoted relative to the base assembly by applying a torque to the second handle.

Additional objects and advantages of the invention will be apparent from the detailed description of the preferred embodiment, the appended claims and the accompanying drawings or may be learned by practice of the invention.

BRIEF DESCRIPTION OF THE DRAWINGS

The accompanying drawings which are incorporated in, and constitute a part of, this specification illustrate two embodiments of the invention and together with the description serve to explain the principles of the invention. In the drawings the same reference numerals indicate the same parts.

DESCRIPTION OF THE PREFERRED EMBODIMENTS

Figure 1:
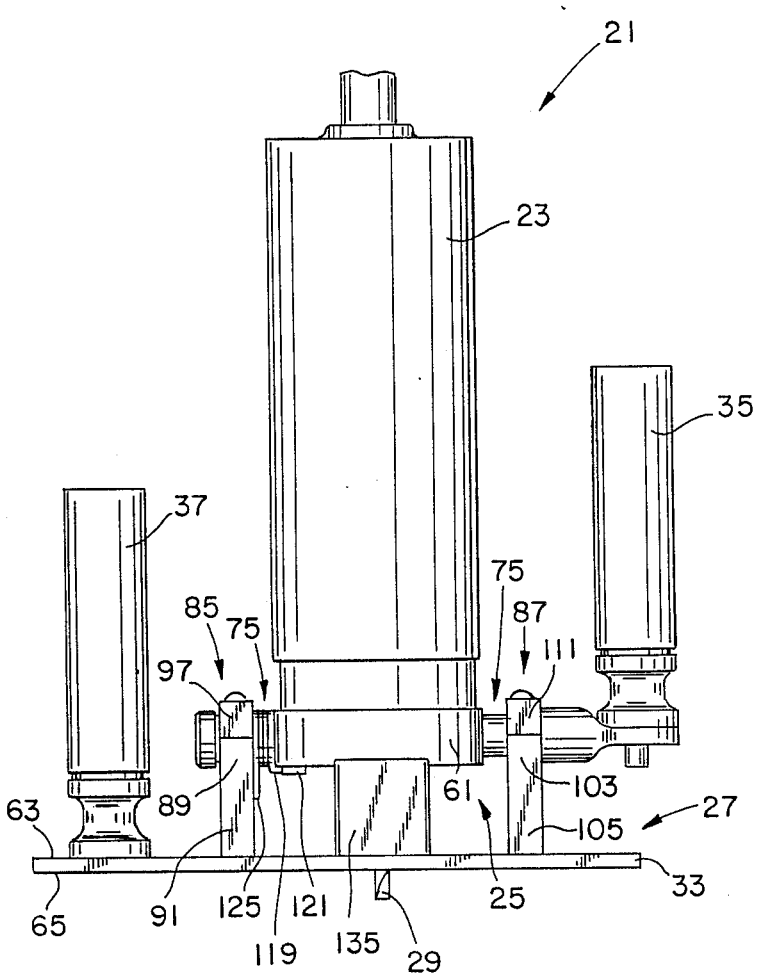
FIG. 1 is a side elevational view of a jointer in accordance to the invention herein. The jointer is shown in a first orientation with the bit oriented perpendicular with the base plate.
Figure 2:
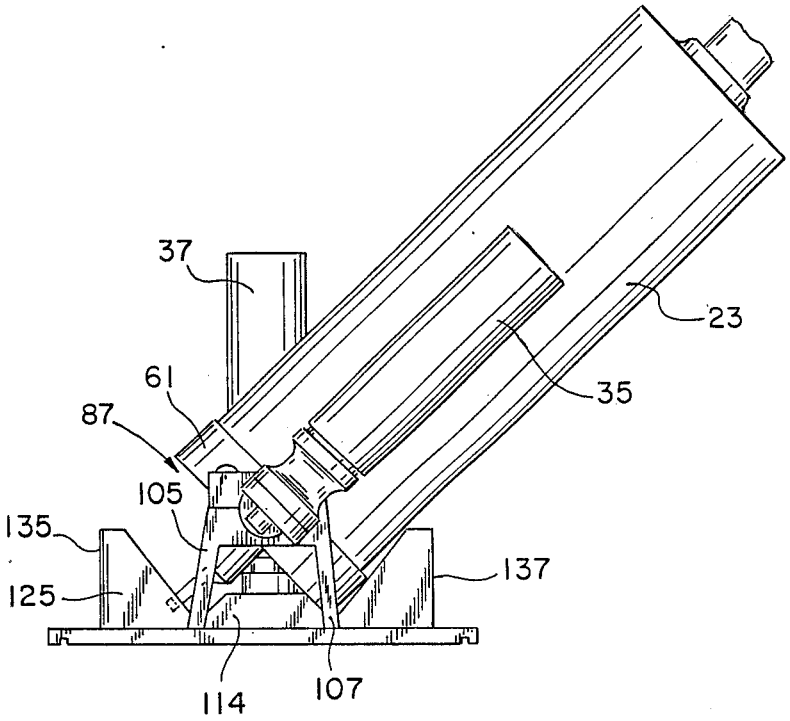
FIG. 2 is a side elevational view of the jointer shown in FIG. 1 but located in a second orientation with the bit in a rest position.

The preferred embodiment of the machine is illustrated in FIGS. 1, 2. Details of the embodiment are shown in FIGS. 3–12.

The preferred embodiment is a biscuit jointer and is used to make slots in a workpiece by pivoting an elongated, generally cylindrical bit about an axis of rotation such that the distal bit tip is swept through an arcuate cutting path in the workpiece. The slots are used in the formation of biscuit joints between two workpieces.

In brief, as best shown in FIGS. 1–4A, the biscuit jointer 21 comprises an elongated motor housing 23, a motor end cap assembly 25 fixed to one end of housing 23 and a base assembly 27 for engagement with a workpiece. To form a biscuit receiving slot in a workpiece, the motor housing 23 and end cap assembly 25 are pivoted relative to base assembly 27 for sweeping a bit 29 through an opening 31 in base plate 33. The sweeping action is effected by an operator rotating a handle 35 fixed to end cap assembly 25 counterclockwise (FIG. 4A) relative to base assembly 27. Handle 37 is used to stabilize the base assembly 27 as the housing 23 is pivoted to form the slot.

Figure 3:
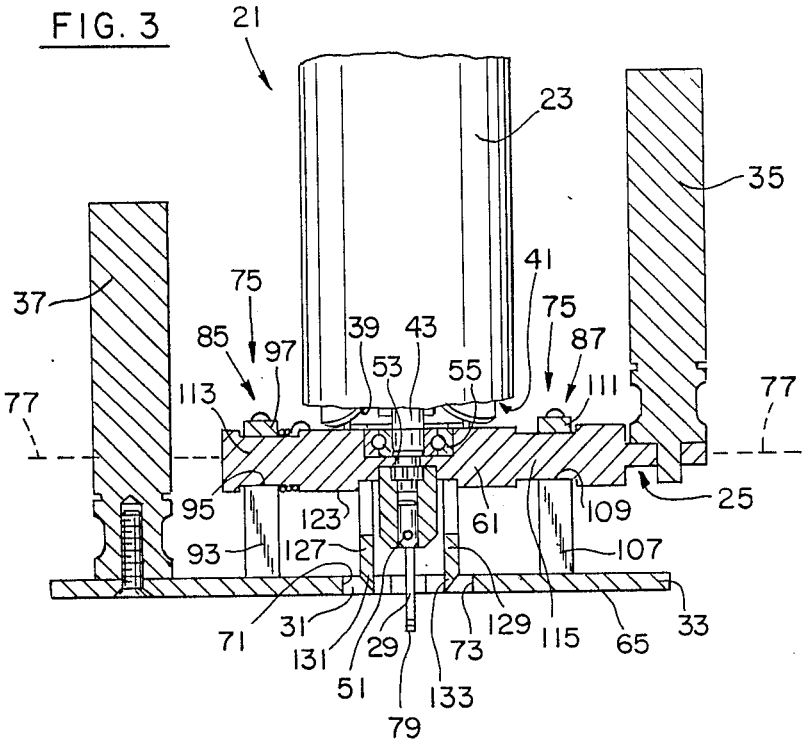
FIG. 3 is a cross-sectional view of the jointer as shown in FIG. 1.
Figure 4A:
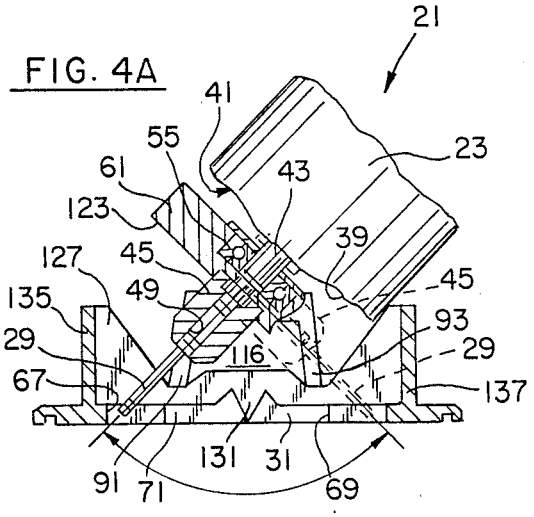
FIG. 4A is a cross-sectional view of the jointer as shown in FIG. 2.
Figure 4B:
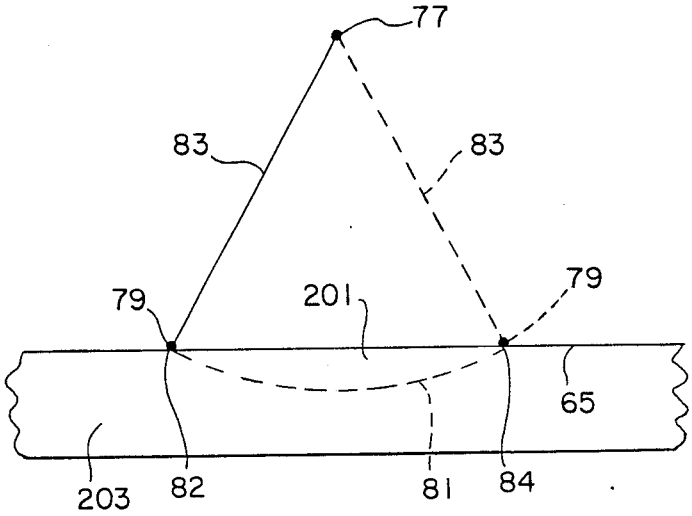
FIG. 4B is a schematic view of the movement of the bit of the jointer of FIG. 1 for forming a wafer receiving slot in a workpiece.
Figure 5:
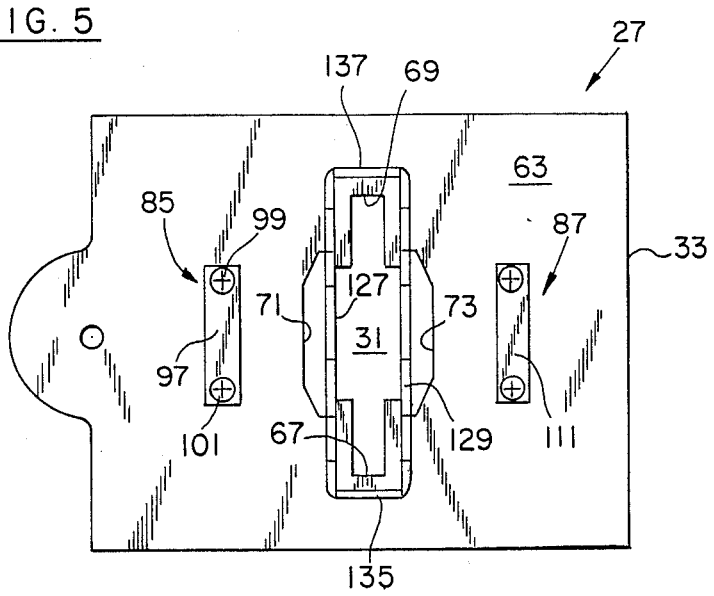
FIG. 5 is a plan view of the base assembly of the jointer shown in FIG. 1.
Figure 6:
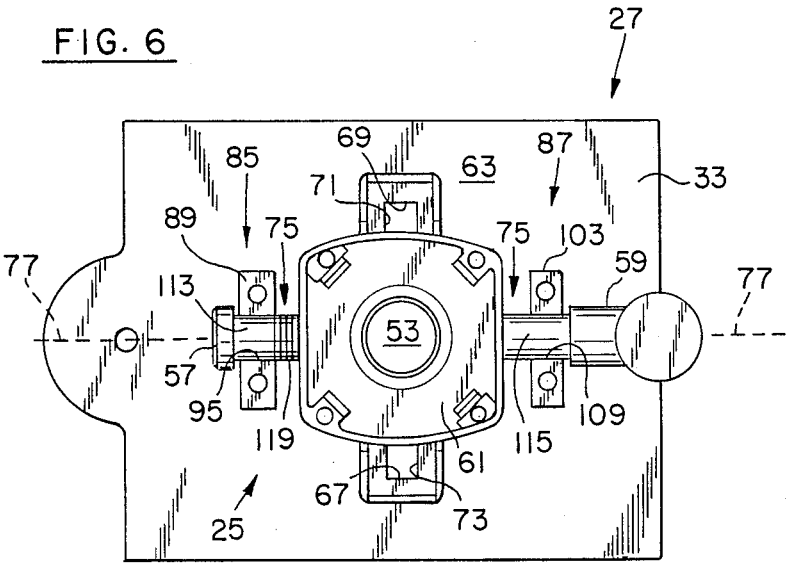
FIG. 6 is a plan view of the end cap assembly and base assembly of the jointer as shown in FIG. 1.
Figure 7:
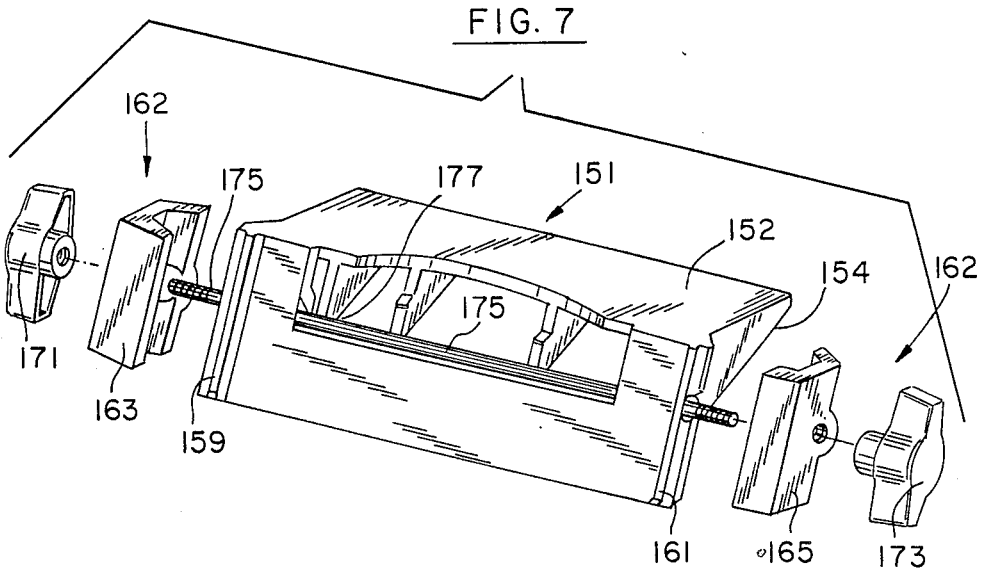
FIG. 7 is an exploded perspective view of the fence assembly which is an accessory for the jointer of FIG. 1.

Motor housing 23 is preferably elongated and has an opening 39 at one end. As best seen in FIGS. 3, 4A, motor 41, preferably a universal motor, is enclosed within housing 23 and comprises an armature shaft 43 which is aligned in the direction of elongation of housing 23 and extends through housing opening 39. Motor 41 preferably provides an output angular velocity, comparable to that used for conventional routers, in the range of 18,000 to 30,000 r.p.m. An angular velocity of about 25,000 r.p.m. is preferred. A chuck 45 is fixed to one end of armature shaft 43 by a press fit and has an axial cavity 49 for receiving bit 29. Bit 29 is held by a set screw 51 in a fixed, location in cavity 49 coaxial with shaft 43. Bit 29 is preferably a conventional end mill router bit, however, other generally cylindrical, elongated bits may be used.

Motor end cap assembly 25 (FIGS. 3, 4A, 6) is fixed across housing opening 39 and has a central opening 53 through which chuck 45 extends. A bearing 55 is also supported in opening 53 for rotatably mounting armature shaft 43. End cap assembly 25 further comprises a pair of trunnions 57, 59 extending, respectively, from opposite sides of cap 61 transverse to armature shaft 43 for a pivotally mounting housing 23 relative to base assembly 27.

In accordance with the invention, base assembly has a back face and a planar front face for engagement with a workpiece and an opening with opposed end walls. As embodied herein, base assembly 27 (Figs. 1, 5) includes the base plate 33 which has a back face 63, preferably planar, a planar front face 65 for engagement with a workpiece and opening 31 through which bit 29 is swept to form a slot in a workpiece. Opening 31 is formed by opposed end walls 67, 69 and opposed sidewalls 71, 73.

In accordance with the invention, jointer 21 further comprises means for pivotally mounting the motor housing on the back face of the base assembly for rotation about an axis and for sweeping the bit through the base opening and the distal bit tip through an arc, said arc defined by a fixed radius, intersecting with two spaced points in the plane of the front face and extending outwardly from the front face between the two points. As embodied herein, a means 75 (FIGS. 2-4B, 6) pivotally mounts motor housing 23 on the back face 63 of base plate 33 for rotation about an axis 77 and for sweeping the bit 29 through base opening 31 and the distal bit tip 79 through an arc 81 with a fixed radius 83 during the traversal of the tip through base opening from one end wall 67 to the other end wall 69. Axis 77 is perpendicular to and intersects the longitudinal axis of bit 29. Arc 81 (FIG. 4B) is defined by fixed radius 83, intersects two spaced points 82, 84 in the plane of the front face 65 and extends outwardly from front face 65 between points 82, 84. Preferably, the pivot means 75 comprises the pair of trunnions 57, 59 extending from cap 61 and a spaced pair of stanchions 85, 87 extending from the back face 63 of base plate 33 on opposite sides 71, 73, respectively, of base opening 31. Each of stanchions 85, 87 receives and pivotably mounts a respective one of the trunnions 57, 59. Stanchion 85 includes a base 89 having spaced legs 91, 93 and a cylindrical opening 95 formed between base 89 and a stanchion cover 97. Cover 97 is fixed to base 89 by pair of spaced screws 99, 101. Similarly, stanchion 87 is comprised of base 103, spaced legs 105, 107, opening 109 and cover 111. Each trunnion 57, 59 includes, respectively, a cylindrical axle 113, 115 for rotatably mounting in stanchion openings 95, 109 respectively. To improve the visibility of a workpiece, large openings 114, 116 are formed respectively, between legs 91, 93 and between legs 105, 107. Alternatively, pivot means 75 may comprise a single trunnion 59 (extending from cap 61) and stanchion 87 rather than the preferred pair of trunnions 55, 59 and pair of stanchions 85, 87.

Preferably, a bias means 119 biases the end cap assembly 27 relative to the stanchions 85, 87 to locate the cutter tip 79 in a rest position (depicted in FIGS. 2, 4A) adjacent to ore of the opposed end walls 67, 69 of base opening 31, namely, end wall 67. Bias means 117 is preferably a torsion spring coaxially mounted on trunnion axle 113 with one spring arm 121 in engagement with a cap face 123 and a second spring arm 125 in engagement with base 89 stanchion 85 to bias end cap assembly 25 clockwise relative to base assembly 27 as viewed in FIGS. 2, 4. If desired, a second torsion spring (not shown) may be provided on trunnion axle 115 to increase the clockwise bias of housing 23 relative to base assembly 27 (FIGS. 2, 4A). Other bias means such as an extension spring and other spring systems may be used.

In the preferred embodiment, the base assembly 27 (FIG. 6) may further comprise a pair of space parallel walls 127, 129 on back face 63 of base assembly 27. Walls 127, 129 extend between end wall 67, 69 and are perpendicular to the front face 65 and to the axis of rotation 77 for aligning the bit 29 with the workpiece to determine the lateral location of the formation of a slot relative to a lateral demarcation on the workpiece such as an edge or marking. This alignment is, for example, desirable to determine the proper lateral location of "mating" slots (i.e., the slot in each of two workpieces to be joined by the same wafer.) Each wall 127, 129 has an index 131, 133, (FIGS. 3, 4) respectively, for alignment with a longitudinal demarcation on a workpiece to identify the site where the maximum depth of cut into the workpiece will be made by the bit 29. Such an index is desirable to provide proper longitudinal alignment of mating slots. Preferably debris guard walls 135, 137 (FIGS. 1, 2, 5) are formed, respectively, across the adjacent ends of alignment walls 127, 129 to shield and deflect debris from an operator. For improved visibility of the workpiece, alignment walls 127, 129 (FIG. 5) are formed inwardly of opposed sidewalls 71, 73 of base opening 31.

In the preferred embodiment for use by the operator in rotating the housing 23 relative to base assembly 27 to form a slot in a workpiece, the jointer 21 further comprises first and second handles 35, 37 (FIGS. 1-3). Handle 37, which is fixed to and extends from the back face 63 of base plate 33, allows the operator to stabilize and maintain the base assembly 27 in a precise location on a workpiece. Handle 37, is preferably is fixed to base plate 33 with a screw 143 inserted through an opening 145 and is located adjacent to and outwardly from trunnion 57. Handle 35 is fixed (directly or indirectly) to the pivot means 75 for pivoting motor housing 23 relative to base assembly 27 and sweeping bit 29 through base opening 31 Preferably, as shown in FIGS. 2, 3, handle 35 is fixed to trunnion 59 outwardly of stanchion 87 with a bolt 147 inserted through an opening 149 in the end of trunnion 59. Alternatively, handle 35 may be fixed to cap 61 (or housing 23) preferably with its longitudinal axis intersecting the rotational axis 77 or passing slightly to the left (with the jointer oriented as shown in FIG. 2) of axis 77.

Handles 35, 37 have been found to be particularly advantageous for holding base assembly 27 stable during operation of jointer 21. When making a slot in a workpiece an upward force tending to lift jointer 21 from the workpiece is produced by the force of bit 29 on the workpiece. Therefore, it is critical in making an accurate cut to maintain a positive downward force against the workpiece. A portion of the downward force is applied through handle 37. The reminder of the downward force is applied through handle 35. By gripping handle 35 near the axis of rotation 77, both a downward force and a torque may be applied simultaneously. Thus by applying significant downward forces on both handle 35, 37, it is possible to form the slots in a workpiece without a significant tendency for base assembly 27 to be lifted from the workpiece.

In the preferred embodiment, jointer 21 may further comprise a means 150 for adjusting fixed radius 83 to permit the formation of slots of different sizes to accommodate wafers of different sizes. Radius 83 may be adjusted in two ways to control the location of arc 81 relative to face 65. First, radius 83 may be adjusted (1) by changing its length and (2) by moving its location relative to base plate 33. As embodied herein, means 150 is preferably constituted by bit 29 and chuck 45 (FIG. 3). Bit 29 is longitudinally slidable within axial cavity 49 of chuck 45 which thereby permits adjustment of the distance or radius between bit tip 79 and rotational axis 77. Also, the adjustment means 150 may be constituted by a yoke assembly 231 as shown schematically in FIGS. 12A, 12B. Yoke 231 permits axis 77 to be adjusted toward and away from face 65 of base plate 33.

In accordance with the invention, base assembly 27 may further comprise a conventional reversable fence 151 (FIGS. 7-9) movably mounted on the front face 65 of base plate 33 toward and away from bit 29 in a direction 153 parallel to the rotational axis 77. Fence 151 may be reversably mounted on face 65 such that either a 90° guide surface 152 or a 45° guide surface 154 faces bit 29. As is well known, fence 151 is used as a guide for locating and laterally aligning jointer 21 relative to a workpiece edge prior to forming in an adjacent edge surface a slot parallel to and spaced a predetermined distance from the edge. To guide the movement of fence 151 relative to base plate 33, the front face 65 of base plate 33 has a pair of spaced parallel grooves 155, 157 extending parallel to the direction of movement 153 and slidably receiving a pair of spaced parallel tongues 159, 161, respectively, extending from fence 151. To retain the fence 151 in an adjusted position, base assembly 27 further comprises a clamp 162 for releasably fixing fence 151 to base plate 33. Clamp 162 includes a pair of jaws 163, 165 releasably engagable with opposed parallel edges 167, 169 of base plate 33. The jaws 163, 165 are releasably engagable with the base plate edges 167, 169 by tightening and loosening handles 171, 173 which are, respectively, threadably mounted on each end of a clamping rod 175. Rod 175 is recessed in a channel 177 in a guide surface 179 of fence 151.

Figure 8:
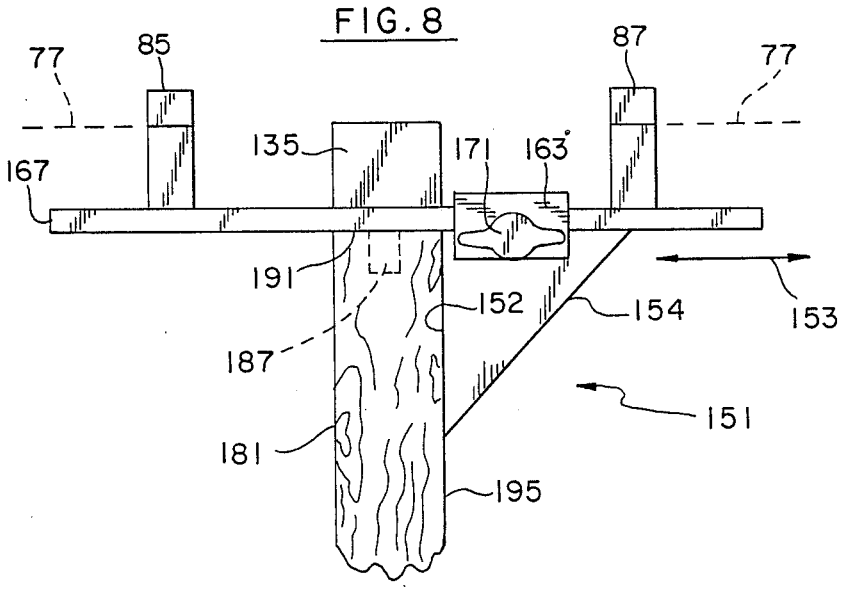
FIG. 8 is a schematic view of the base and fence assemblies illustrating one application for the fence assembly.
Figure 9:
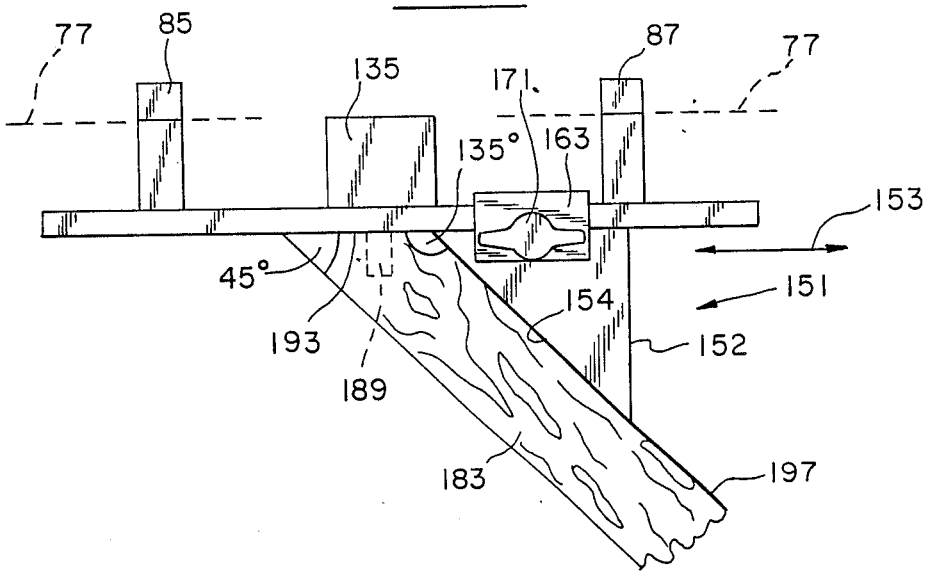
FIG. 9 is a schematic view of the base and fence assemblies illustrating a second application for the fence assembly.

As shown in FIGS. 8, 9, guide surfaces 152, 154 are used to position base assembly 27 on workpieces 181, 183 to form slots 187, 189, respectively, in workpiece edges 191, 193 at a 90° angle and at a 135° (interior) angle relative to adjacent reference surfaces 195, 197 of workpieces 181, 183. To form 187 slot in 90° edge 191, surface 152 is positioned facing bit 29 and is engaged with reference surface 195 perpendicular to workpiece edge 191 through which slot 187 is formed. To form slot 189 in 45° workpiece edge 189, surface 154 is positioned facing bit 29 and is engaged with reference surface 197 at an interior 135° angle to workpiece edge 193 through which slot 189 is formed.

Figure 10:
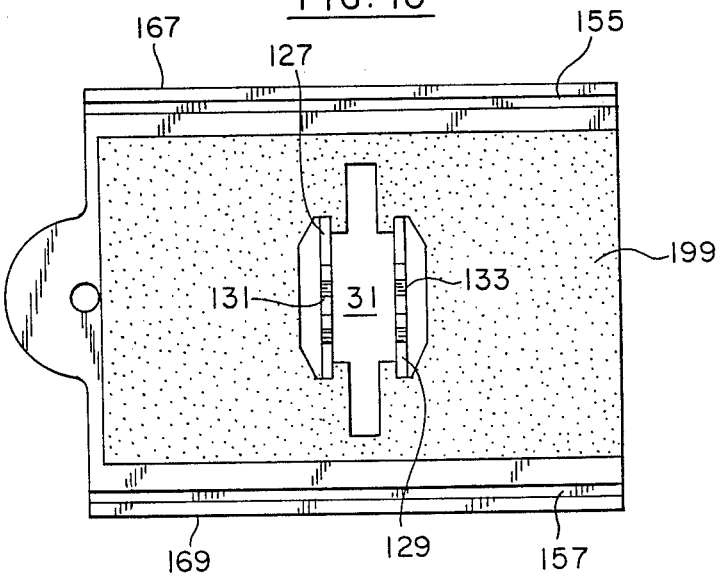
FIG. 10 is a plan view of the front face of the base assembly of the jointer of FIG. 1.
Figure 11A:
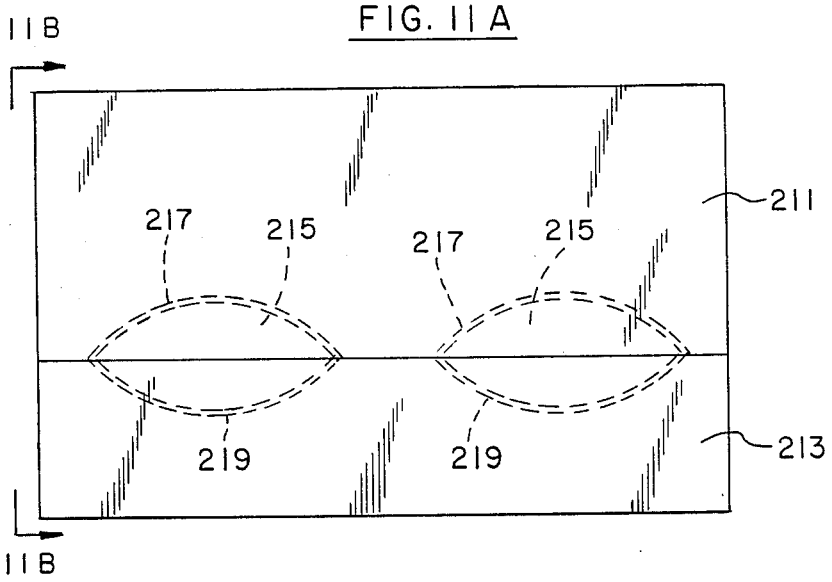
FIG. 11A is a side elevational view taken along line 11A—11A of FIG. 11B illustrating one type of biscuit joint which may be formed with the jointer of FIG. 1.
Figure 11B:
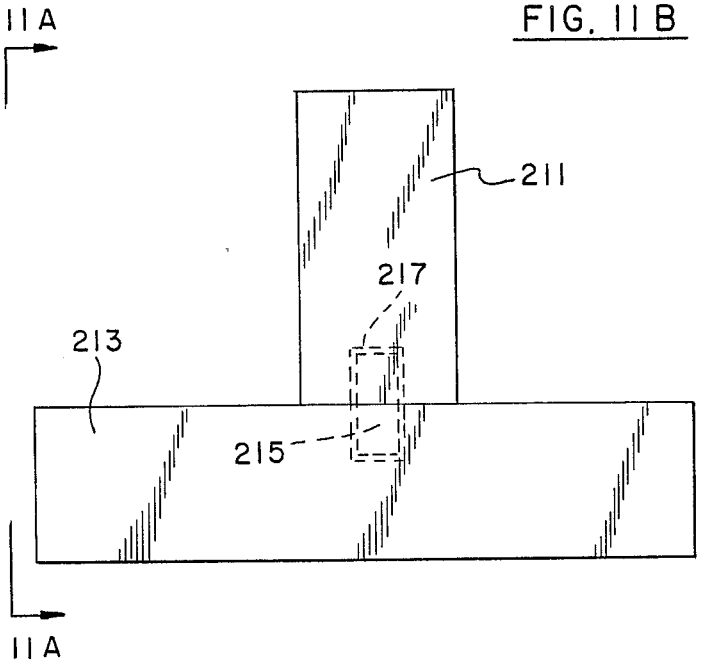
FIG. 11B is a side elevational view taken along line 11B—11B of FIG. 11A.

As shown in FIG. 10, to increase the stability of the base assembly 27 on a workpiece, an abrasive material 199 is applied to a substantial portion of the front face 65 of base assembly 27. Abrasive material 199 is preferably an adhesive backed sand paper. As would be appreciated when front face 65 of base plate 33 is engaged with a work surface abrasive 199 is engaged with the work surface to aid in stabilizing the base assembly 27 at the correct location without damaging the surface of the workpiece.

The method for using jointer 21 to form biscuit joints is another important aspect of the invention. According to this aspect of the invention, a method is provided for forming a biscuit joint between two workpieces which comprises a first step of locating the base assembly 27 on the first workpiece. Base assembly 27 is located on the first workpiece by locating base plate 33 flush with the workpiece surface in which the slot is to be cut. Alternatively, if the slot is to be formed in a workpiece edge 191 adjacent to a reference surface 195 perpendicular to the edge 181, fence 151 may be used by engaging fence surface 152 with the perpendicular reference surface 195. Alternatively as explained above and shown in FIG. 9, if the slot is to be formed in a workpiece edge 193 adjacent to a reference surface 197 at an interior 135° angle to the edge, fence 151 may be used by engaging fence surface 154 with the reference surface 197 at the 135° angle to the edge 193. If the slot is to be formed in a workpiece surface without adjacent 90° or 135° reference surfaces, one of the alignment walls 127, 129 is aligned with a lateral demarkation on the first workpiece then one of the indexes 131, 133 on walls 127, 129 is aligned with a longitudinal demarkation on the first workpiece to identify the site where the maximum depth of cut into the workpiece will be made.

According to the invention, the method further comprises a second step of pivoting the housing 23 relative to base assembly 27 about the rotational axis 77 for sweeping bit 29 through an arc 81 to form a first slot 201 in the first workpiece 203. The slot has a width equal to the diameter of bit 29 and a radiused bottom defined by the radius 83 between the rotational axis 77 and the distal bit tip 79. Preferably, the pivoting step is performed by (1) gripping in one hand handle 35 fixed to base assembly 27, (2) gripping in the other hand second handle 37 fixed to the means 75 for pivotally mounting the housing 23 to base assembly 27 and spaced outwardly from housing 23 and (3) applying a torque to handle 37 to rotate bit 29 through opening 31 from the rest position adjacent to end wall 67 to a location adjacent opposed end wall 69. As is well known, one or more of such slots may be formed in this manner at spaced locations in the first workpiece.

According to the invention, the method further comprises a third step of locating base assembly 27 on the second workpiece in the same manner as described above for the first workpiece.

According to the invention, the method further comprises a fourth step of pivoting the housing 23 relative to the base assembly 27 to form a second slot in the same workpiece in the same manner as described above for forming the first slot in the first workpiece.

According to the invention, the formation of the joint is completed in a conventional, well understood manner for forming biscuit joints. These steps include (1) applying glue in the one or more slots formed in the first and second workpieces and preferably along the edges of the workpieces to be abutted, (2) partially inserting a wafer (preferably one-half of the wafer) in the first slot and (3) then inserting the portion of the wafer protruding from the first slot into the second slot to form a joint between the two workpieces. The two workpieces are then preferably clamped to hold the workpieces in abutment while the glue is permitted to dry.

In the preferred embodiment, the method may further comprise the step of prior to the formation of the first, and second slots, adjusting the distance between the rotational axis 77 and the distal bit tip 79 to vary the size of the first and second slots to be formed adjusting axis 77 toward and away from face 65 plate 33. The adjustment permits an appropriate slot size to be formed corresponding to the three wafer sizes (55×8×4mm; 60×1O×4mm; 65×12×4mm) which are in common use.

Figure 12B:
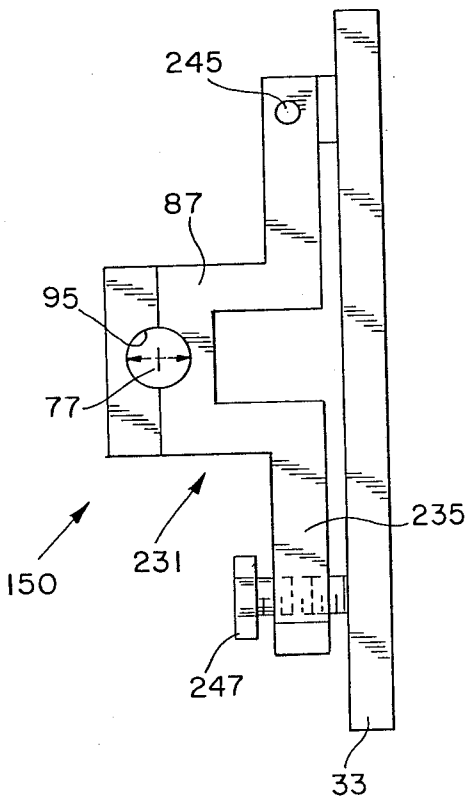
FIG. 12B is a schematic side elevational view taker along line 12B—12B of FIG. 12A.
Figure 12A:
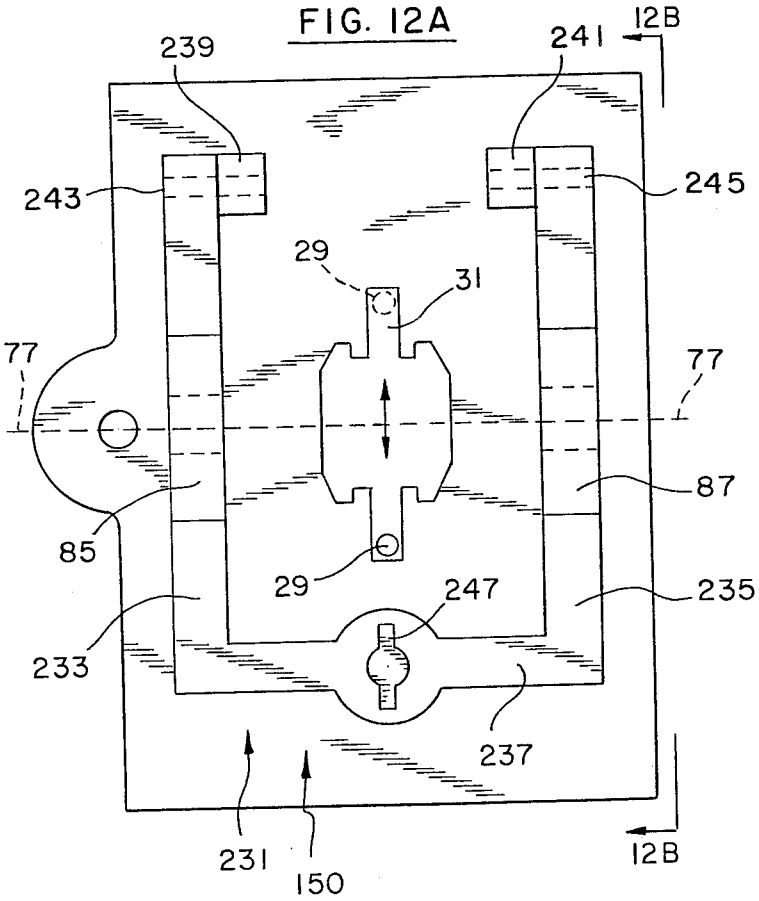
FIG. 12A is a plan schematic view of a second embodiment of a base assembly of a jointer in accordance with the invention herein.

As shown in FIGS. 12A, 12B, an alternative embodiment of the mean 150 for adjusting fixed radius 83 to permit formation of slots of different sizes to accommodate wafers of different sizes may be constituted by yoke assembly 231. Yoke assembly 231 includes a pair of arms 233, 235, which incorporate stanchions 85, 87, and a cross-arm 237 connecting arms 233, 235. Yoke 231 is pivotally supported on a pair of spaced supports 239, 241 and a pair of pivot pins 243, 245. A screw 247 is threadably mounted in cross-arm 237 and is adjustable toward and away from back face 63 of base plate 62 to adjust rotational axis 77 toward and away from the front face 65 of base plate 33 when axis 77 is moved toward face 65, bit tip 79 projects further beyond face 65 and bit 29 cuts a deeper slot. When axis 79 is moved away from face 65, bit tip 79 is retracted relative to face 65 and bit 29 cut a shallower slot.

It will be appreciated from the foregoing, that a jointer in accordance with the invention herein provides a low cost tool and method for its use for forming biscuit joints. As discussed above, conventional biscuit jointers use saw blades (e.g., 4" in diameter), preferably carbide tipped, driven by a universal motor through a right angle gear train and drive shaft. In contrast, jointer 21 uses an elongated bit coupled to the armature shaft of the drive motor with a chuck eliminating the right angle gear train, drive shaft and some of the bearings normally used in conventional jointers. The use of an elongated bit such as an end mill router bit rather than a saw blade reduces the initial cost of such a tool as an end mill router bit is approximately 20% percent of the cost of a carbite tipped 4" saw blade. No data is available on the relative life of an end mill router bit compared to a carbide tip saw blade for forming biscuit joint slots.

A further advantage of the invention is that use of a direct drive rather than a gear train eliminates the noise generated by the gear train.

Another advantage of the invention resulting from the elimination of parts compared to conventional biscuit jointers is that invention herein provides a jointer which is light in weight contributing to the maneuverability of the jointer.

It will be apparent to those skilled in the art that various modifications and variations can be made in the method and jointer of the present invention without departing from the scope or spirit of the invention. Thus, it is intended that the present invention cover these modifications and variations provided they come within scope of the appended claims and their equivalents.

We claim:

1. A biscuit jointer comprising:

a motor for driving an elongated bit;

a motor housing for the motor;

a base assembly having a back face and a planar front face for engagement with a workpiece and an opening with opposed end walls; and means for pivotally mounting the motor housing on the back face of the base assembly for rotation about an axis and for sweeping the bit through said base opening and the distal bit tip through an arc, said arc defined by a fixed radius, intersecting with two spaced points in the plane of the front face and extending outwardly from the front face between the two points.

2. The cutter of claim 1 further comprising a chuck with an axial cavity for holding the bit, the fixed radius of the bit being adjustable by adjusting the extension of the bit from the chuck cavity.

3. The cutter of claim 1 wherein the pivot means comprises means for adjusting the rotational axis of the pivot means toward and away from the front face of the base assembly for adjusting the fixed radius.

4. The cutter of claim 1 wherein the base assembly further comprises a pair of spaced, parallel walls on the back face of the base assembly, said walls extending between said opposite sides of the base opening, said walls extending perpendicular to the front face for aligning the bit with the workpiece, each of the walls having an index for identifying on a workpiece the site where the maximum depth of cut into the workpiece will be made.

5. The cutter of claim 1 wherein the pivot means comprises a pair of spaced stanchions and a pair of trunnions extending from opposite sides of the housing, each trunnion supported in a respective one of the stanchions.

6. The cutter of claim 5 further comprising a torsion spring having a coil coaxially mounted on one trunnion, one spring arm in engagement with the cap and a second spring arm in engagement with one stanchion to bias the motor housing relative to the base assembly to locate the cutter tip in a rest position adjacent to one of the end walls of the base opening.

7. The cutter of claim 1 further comprising a biasing means for biasing the cutter tip to a location adjacent to one of said opposite sides of the base opening.

8. The cutter of claim 1 further comprising:

a first handle fixed to and extending from the back face of the base assembly; and a second handle, fixed to the pivot means, for pivoting the motor housing relative to the base and sweeping the bit through said base opening.

9. The cutter of claim 5 further comprising a first handle fixed to the back face of the base adjacent to one of said trunnions and a second handle fixed to the other of said trunnions for pivoting the motor housing relative to the base and sweeping the bit through said base opening.

10. The cutter of claim 1 wherein an abrasive material is applied to a substantial portion of the front face of the base assembly.

11. The cutter of claim 10 wherein said material is sandpaper.

12. The cutter of claim 1 wherein:

the motor housing is elongated and has an opening at one end;

the motor comprises an armature shaft aligned in the direction of elongation of the housing ant extends through the housing opening;

a chuck is connected to the shaft for mounting the bit;

an end cap is fixed to the housing, extends across the housing opening, and has an opening through which the chuck extends; and the mounting means comprises:

a pair of trunnions extending, respectively, from opposite sides of the end cap transverse to the armature shaft; and a spaced pair of stanchions extending from the back face of the base on opposite sides of the base opening, each of said stanchions receiving a respective one of the trunnions.

13. A biscuit jointer cutter comprising:

a motor including an armature shaft;

an elongated housing for the motor, said housing having an opening at one end;

a chuck connected to the armature shaft for mounting an elongated cutter;

an end cap assembly fixed across the housing opening, having an opening through which the chuck extends and comprising a pair of trunnions extending, respectively, from opposite sides of the end cap transverse to the armature shaft;

a base assembly comprising a base plate including a back face, a planar front face for engaging a workpiece, and an opening; and a pair of spaced stanchions extending, respectively, from the back face on opposite sides of the base opening, each stanchion receiving, respectively, one of the trunnions for mounting the housing for rotation about an axis transverse to the armature shaft;

a first handle fixed to and extending from the back face of the base adjacent to one of the trunnions;

a second handle fixed to the other of the trunnions for rotating the housing about the transverse axis sweeping the bit through the base opening and sweeping the distal bit tip through an arc; and a biasing means for biasing the end cap assembly relative to the stanchions to locate the cutter tip in a rest position adjacent to one of the opposite end walls of the base opening.

14. The cutter of claim 13 wherein the radius between the distal bit tip and the rotational axis is fixed when the distal bit tip is swept through said arc.

15. The cutter of claims 1 or 13 wherein the base assembly comprises a fence movably mounted on the front face of the base plate toward and away from the bit in a direction parallel to the rotational axis.

16. The cutter of claim 15 wherein the base assembly includes a clamp for releasably fixing the fence to the base plate, said clamp comprising a pair of jaws engageable with opposed parallel edges of the guide plate.

17. The cutter of claim 16 where the fence has a surface perpendicular to front face of the base and a second surface at a 45° angle to the front face.

18. The cutter of claim 15 wherein the front face has a pair of spaced parallel grooves parallel to said direction of movement; and the fence comprises a pair of spaced, parallel tongues slidably received, respectively, within the pair of grooves.

19. A method for forming a joint between two workpieces with a tool comprising a motor for driving an elongated bit, a base assembly, and a motor housing pivotally mounted to the base assembly for rotation about an axis transverse to the bit, said method comprising with steps of:

locating the base assembly on a first workpiece;

pivoting the housing relative to the base assembly about the rotational axis for sweeping the bit through an opening in the base assembly and the distal bit tip through an arc to form a first slot in the first workpiece having a width equal to the diameter of the bit and a radiused bottom defined by the radius between the rotational axis and the distal bit tip;

locating the base assembly on a second workpiece;

pivoting the housing relative to the base assembly about the rotational axis for sweeping the bit through the opening and the distal bit tip through an arc to form a second slot in the second workpiece having a width equal to the diameter of cutter and a radiused bottom defined by the radius from the rotational axis to the distal bit tip;

applying glue in the slots;

partially inserting a wafer in the first slot; and inserting a portion of the wafer protruding from the first slot into the second slot to form a joint between the two workpieces.

20. The method of claim 19 further comprising the steps of: (a) aligning a wall with a lateral demarkation on the first workpiece; said wall extending between opposed end walls of the base assembly opening and perpendicular to the rotational axis of the bit and (b) aligning an index on the wall with a longitudinal demarkation on the workpiece to identify on the first workpiece the site where the maximum depth of cut into the workpiece will be made; and performing steps (a) and (b) above on the second workpiece.

21. The method of claim 19 further comprising a step of prior to the formation of the first and second slots, adjusting the distance between the rotational axis and the distal bit tip to vary the size of the first and second slots to be formed.

22. The method of claim 15 further comprising the steps of:

gripping in one hand a first handle fixed to the base assembly;

gripping in the other hand a second handle fixed to a means for pivotably mounting the housing to the base assembly and spaced outwardly from the housing; and said step of pivoting the housing relative to the base assembly performed by applying a torque to said second handle.

* * * * *